US011805833B1

(12) United States Patent
Vahos

(10) Patent No.: US 11,805,833 B1
(45) Date of Patent: Nov. 7, 2023

(54) FLEXIBLE HAIR EXTENSION WITH FORM RETENTION CAPABILITY

(71) Applicant: Julie Vahos, Crystal Lake, IL (US)

(72) Inventor: Julie Vahos, Crystal Lake, IL (US)

( * ) Notice: Subject to any disclaimer, the term of this patent is extended or adjusted under 35 U.S.C. 154(b) by 546 days.

(21) Appl. No.: 16/816,408

(22) Filed: Mar. 12, 2020

Related U.S. Application Data

(60) Provisional application No. 62/846,542, filed on May 10, 2019.

(51) Int. Cl.
*A41G 5/00* (2006.01)

(52) U.S. Cl.
CPC ..... *A41G 5/0046* (2013.01); *A41G 5/0053* (2013.01)

(58) Field of Classification Search
CPC .... A41G 5/004; A41G 5/0046; A41G 5/0053; A41G 5/0006; A41G 5/0013; A41G 5/0026
See application file for complete search history.

(56) References Cited

U.S. PATENT DOCUMENTS

| | | | | |
|---|---|---|---|---|
| 4,830,029 | A | 5/1989 | Bird | |
| 6,170,491 | B1 * | 1/2001 | Maekawa | A41G 5/0006 132/54 |
| 7,032,602 | B2 | 4/2006 | Chang | |
| 7,854,233 | B2 | 12/2010 | Freelove | |
| 9,241,525 | B2 | 1/2016 | Alex | |
| 2005/0268929 | A1 * | 12/2005 | Frazier | A41G 5/004 132/53 |
| 2012/0125356 | A1 * | 5/2012 | Alex | A41G 5/004 206/8 |
| 2016/0227864 | A1 * | 8/2016 | Mosser | A41G 5/004 |
| 2017/0224036 | A1 * | 8/2017 | Kim | A41G 5/0046 |
| 2017/0273382 | A1 | 9/2017 | Tokko | |
| 2018/0035738 | A1 * | 2/2018 | Hayes | A41G 5/0073 |

(Continued)

FOREIGN PATENT DOCUMENTS

| | | |
|---|---|---|
| DE | 202011005549 | 9/2012 |
| GB | 2500252 | 5/2014 |
| JP | 3215867 | 4/2018 |

(Continued)

OTHER PUBLICATIONS

Translation: Lee, Extension Hair Implement, 2008 (Year: 2008).*

(Continued)

*Primary Examiner* — Amy R Sipp
*Assistant Examiner* — Sydney J Pulvidente
(74) *Attorney, Agent, or Firm* — The Law Offices of Konrad Sherinian, LLC; Depeng Bi

(57) ABSTRACT

A flexible hair extension includes an attachment assembly and a plurality of hairs. Each hair within the plurality of hairs is attached to the attachment assembly. The attachment assembly is flexible and can be easily deformed by hands into any geometric shape desired by the user. The attachment assembly retains the new form against gravity of the attachment assembly and the plurality of hairs. The new form can also be easily deformed by hands into another form. The attachment assembly can be a pair of wires twisted together with the plurality of hairs held between the pair of wires. The attachment assembly is adapted to be attached to the user's head using a pair of hair clips on two ends of the attachment assembly.

14 Claims, 7 Drawing Sheets

(56) References Cited

U.S. PATENT DOCUMENTS

2018/0343946 A1* 12/2018 Jensen ..... A41G 5/0046

FOREIGN PATENT DOCUMENTS

| | | | | |
|---|---|---|---|---|
| KR | 100787711 | | 12/2007 | |
| KR | 10019170 | B1 * | 4/2008 | ..... A41G 5/0046 |
| WO | 2011007910 | | 1/2011 | |
| WO | 2012010519 | | 1/2013 | |
| WO | 2013191320 | | 12/2013 | |
| WO | 2016178565 | | 11/2016 | |
| WO | 2018224494 | | 12/2018 | |

OTHER PUBLICATIONS

The Halo, Halo Hair Extensions, https://www.halohairextensions.com/the-halo-hair-extensions.aspx, Google Date of publication: Jan. 2019.

The Ruby—Black Brown, https://prettyparty.com/products/the-ruby-black-brown, 2020 Prettyparty.

* cited by examiner

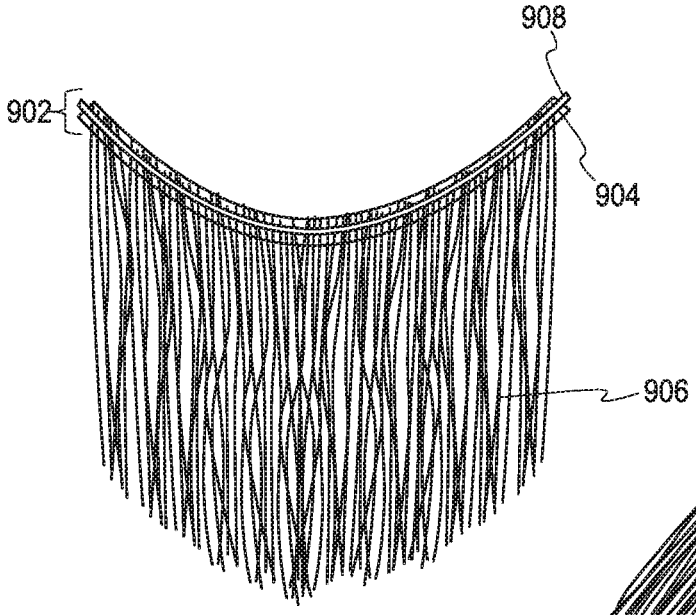
Fig. 9A
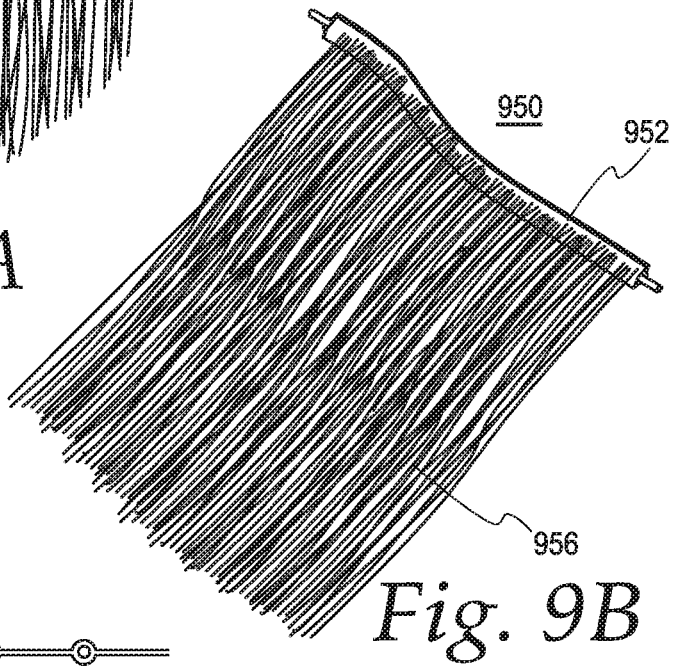
Fig. 9B
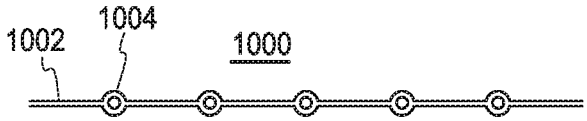
Fig. 10
Fig. 11
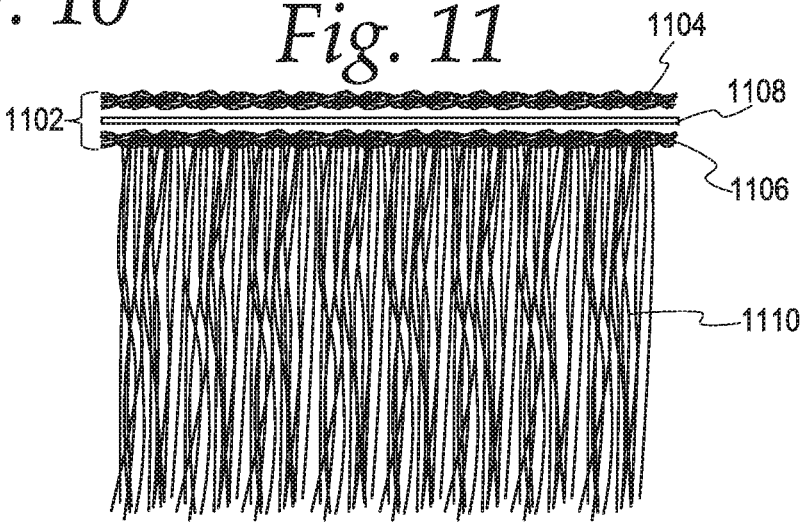

Fig. 12
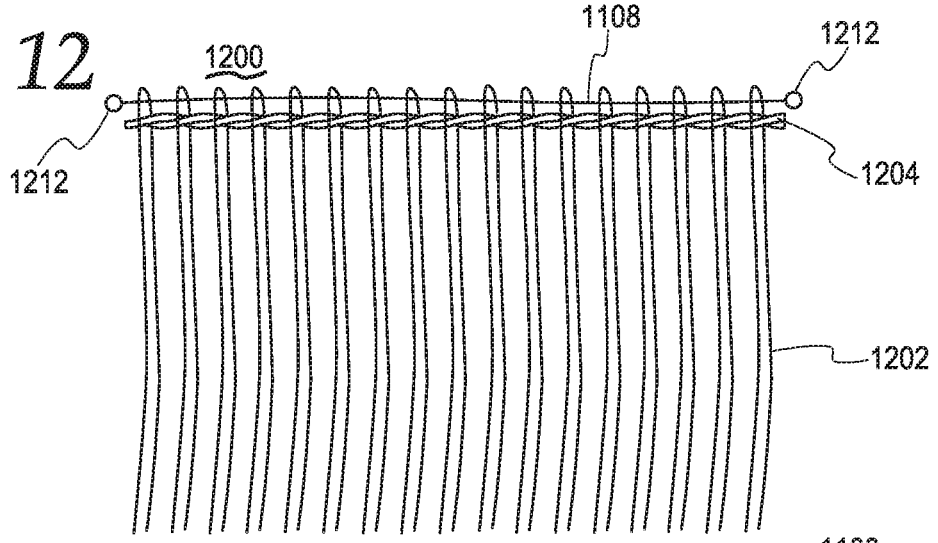
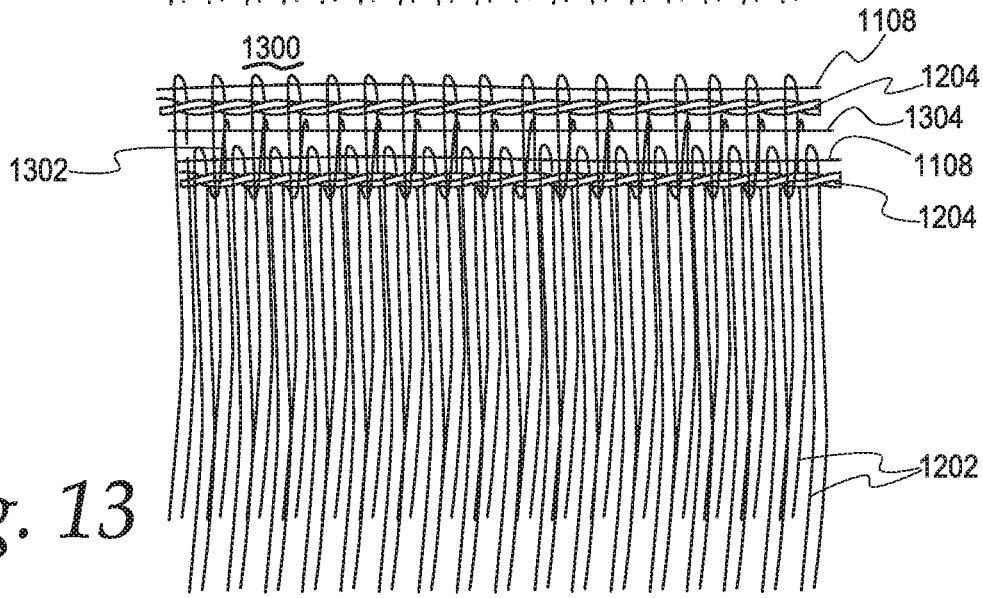
Fig. 13
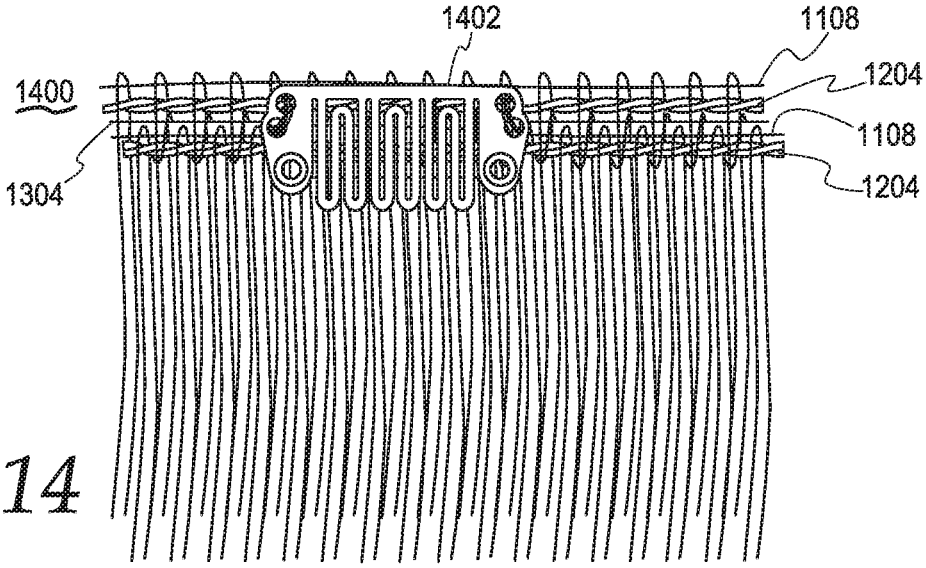
Fig. 14

FLEXIBLE HAIR EXTENSION WITH FORM RETENTION CAPABILITY

CROSS REFERENCE TO RELATED APPLICATIONS

This application claims the benefit and priority of U.S. Provisional Patent Application No. 62/846,542, entitled "FLEXIBLE HAIR EXTENSION WITH FORM RETENTION CAPABILITY", filed May 10, 2019, which is hereby incorporated by reference in its entirety.

FIELD OF THE DISCLOSURE

The present invention generally relates to a hair extension, and more particularly relates to a flexible hair extension that is capable of retaining its form. More particularly still, this disclosure relates to a flexible and form retention hair extension with hairs attached to twisted wires.

DESCRIPTION OF BACKGROUND

Individuals care about their appearance and image. To maintain and/or improve their appearance, beauty, self-esteem and individuality, they take good care of their hair. Hair extensions are thus developed. A hair extension includes a plurality of hairs and an attachment assembly for holding one end of each hair within the plurality of hairs. The attachment assembly is adapted to be attached to one's head. The attachment assembly of a conventional hair extension is entirely flexible and does not retain its form when acted upon by an external force, such as gravity acting upon the attachment assembly and the plurality of hairs. Usually, the attachment assembly of a conventional hair extension is a flexible fiber thread or a different soft and flexible band.

However, a flexible hair extension with the capability of retaining its geometric form is oftentimes desired. For instance, a female may desire a hair extension that she can easily deform to fit her hairline while the deformed shape is retained by the attachment assembly of the new flexible hair extension. As another example, the form retaining new hair extension allows its user to easily achieve a desired shape and style of her hairs. As yet another example, the form retaining new hair extension allows its user to apply it to hairless spots of different shapes and locations on the user's head.

OBJECTS OF THE DISCLOSED SYSTEM, METHOD, AND APPARATUS

Accordingly, it is an object of this disclosure to provide a flexible hair extension with form retention capability.

Another object of this disclosure is to provide a flexible hair extension that can be easily deformed by hands and yet able to retain the new shape.

Another object of this disclosure is to provide a flexible hair extension that can be easily deformed by hands and yet able to retain the new shape against gravity of the hair extension.

Another object of this disclosure is to provide a flexible and form retention hair extension with an attachment assembly having a pair of twisted wires holding a plurality of hairs.

Another object of this disclosure is to provide a flexible and form retention hair extension that can create a new hairline.

Another object of this disclosure is to provide a flexible and form retention hair extension that can create an irregular hairline shape.

Another object of this disclosure is to provide a flexible and form retention hair extension that can create a coiled hairline shape.

Another object of this disclosure is to provide a flexible and form retention hair extension that can be used in a vertical orientation, a horizontal orientation and or an angled orientation.

Another object of this disclosure is to provide a flexible and form retention hair extension that does not require a complete circuit to be attached to a user's head.

Another object of this disclosure is to provide a flexible and form retention hair extension that is adapted to cover irregular spots of hair loss on a user's head without requiring a hairpiece covering the entire head.

Other advantages of this disclosure will be clear to a person of ordinary skill in the art. It should be understood, however, that a system, an apparatus or a method could practice the disclosure while not achieving all of the enumerated advantages, and that the protected disclosure is defined by the claims.

SUMMARY OF THE DISCLOSURE

Generally speaking, pursuant to the various embodiments, the present disclosure provides a flexible hair extension capable of retaining its form. The hair extension includes an attachment assembly and a plurality of hairs attached to the attachment assembly. The attachment assembly is adapted to be attached to a user's head. For example, the attachment assembly is adapted to be attached to a user's natural hairs via a pair of hair clips. The plurality of hairs can be of any colors, sizes or patterns. In one embodiment, the attachment assembly includes a pair of wires twisted together with the plurality of hairs disposed there between. The attachment assembly is flexible enough that a regular person can easily deform it into any desired shape by hands. In any shape the attachment assembly is formed by the hands, it is rigid enough to retain its form against, for example, the gravity of the hair extension. The attachment assembly can be shaped into any forms, such as a circle, a coil, an arc, a wave, etc. The flexibility and form retention capability of the hair extension allow it to be applied in a vertical orientation, a horizontal orientation and an angled orientation. The flexibility and form retention capability of the hair extension also allows it to be applied to create desired styles.

Further in accordance with the present teachings is a flexible hair extension having an attachment assembly. The attachment assembly incorporates a set of hoops for receiving the user's hairs. The flexible hair extension can be easily deformed by hands and is capable of maintaining its geometric shape against gravity of the hair extension.

Further in accordance with the present teachings is a composite hair extension with form retention capability. The composite hair extension includes a first flexible hair extension with form retention capability having a first attachment assembly and a first plurality of hairs attached to the first attachment assembly. The composite hair extension also includes a second flexible hair extension with form retention capability having a second attachment assembly and a second plurality of hairs attached to the second attachment assembly. In addition, the composite hair extension includes a first flexible attachment member. The second flexible hair extension is attached to the first flexible hair extension via the first flexible attachment member. The composite hair extension is form retention capable.

The first attachment assembly includes a first flexible wire with form retention capability wherein the first plurality of hairs are attached to the first flexible wire; two flexible wires with form retention capability twisted together wherein the first plurality of hairs are disposed between the two flexible wires; a second flexible wire with form retention capability and a binding member coupled to the second flexible wire wherein the first plurality of hairs are attached to the binding member; or two wefts and a third flexible wire with form retention capability disposed between the two wefts. The first flexible attachment member is a first hemp cord. The first hemp cord, the first flexible hair extension and the third flexible hair extension are sewed together.

The second attachment assembly includes a first flexible wire with form retention capability wherein the second plurality of hairs are attached to the first flexible wire; two flexible wires with form retention capability twisted together wherein the second plurality of hairs are disposed between the two flexible wires; a second flexible wire with form retention capability and a binding member coupled to the second flexible wire wherein the second plurality of hairs are attached to the binding member; or two wefts and a third flexible wire with form retention capability disposed between the two wefts.

In a further implementation, the composite hair extension of claim 1 includes a third flexible hair extension with form retention capability having a third attachment assembly and a third plurality of hairs attached to the third attachment assembly; and a second flexible attachment member. The third flexible hair extension is attached to the second flexible hair extension via the second flexible attachment member. The third attachment assembly includes a first flexible wire with form retention capability wherein the third plurality of hairs are attached to the first flexible wire; two flexible wires with form retention capability twisted together wherein the third plurality of hairs are disposed between the two flexible wires; a second flexible wire with form retention capability and a binding member coupled to the second flexible wire wherein the third plurality of hairs are attached to the binding member; or two wefts and a third flexible wire with form retention capability disposed between the two wefts. The second flexible attachment member is a second hemp cord. The hemp cord, the second flexible hair extension and the third flexible hair extension are sewed together.

Further in accordance with the present teachings is a hair extension with form retention capability. The hair extension includes an attachment assembly with a set of flexible wires with form retention capability, and a plurality of hairs attached to the attachment assembly. The attachment assembly includes a first weft and a second weft coupled to the first weft and the set of flexible wires includes a single flexible disposed between the two wefts. The plurality of hairs are attached to the second weft. In a different implementation, the attachment assembly includes two weft and the set of flexible wires includes a single flexible disposed between the two wefts. One end of the plurality of hairs is disposed between the two wefts. In another implementation, the attachment assembly includes a binding member and the set of flexible wires includes a single flexible coupled to binding member. The plurality of hairs are attached to the binding member. In yet another implementation, the set of flexible wires includes two flexible wires twisted together the plurality of hairs disposed between the two flexible wires. In further different implementation, the set of flexible wires includes a single flexible wire with form retention capability, and the plurality of hairs are attached to the single flexible wire. The plurality of hairs wrap around the single flexible wire and are sewed together.

Further in accordance with the present teachings is a sliding hair extension form retention capability. The sliding hair extension includes an attachment assembly with a flexible wire that is form retention capable, and a plurality of sliding hair segments attached to the attachment assembly and adapted to slide along the wire. Each sliding hair segment within the plurality of sliding hair segments includes a plurality of hairs. The sliding hair extension also includes two attachment mechanisms at two opposite ends of the flexible wire. The two attachment mechanisms are adapted to attached the sliding hair extension to a target object. The plurality of sliding hair segments are of a same length or different lengths. In one implementation, the plurality of hairs wrap around the flexible wire and are sewn to the plurality of sliding hair segments respectively. Alternatively, each sliding hair segment within the plurality of sliding hair segments includes a weft. The weft is adapted to slide along the flexible wire; and the plurality of hairs are attached to the weft respectively.

BRIEF DESCRIPTION OF THE DRAWINGS

Although the characteristic features of this disclosure will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

FIG. 9A is an illustrative diagram showing the perspective view of a new hair extension in accordance with this disclosure.

FIG. 9B is an illustrative diagram showing the perspective view of a new hair extension in accordance with this disclosure.

FIG. 10 is an illustrative diagram showing the perspective view of a new hair extension in accordance with this disclosure.

FIG. 11 is an illustrative diagram showing the perspective view of a new hair extension in accordance with this disclosure.

FIG. 12 is an illustrative diagram showing the perspective view of a hair extension in accordance with this disclosure.

FIG. 13 is an illustrative diagram showing the perspective view of a composite hair extension in accordance with this disclosure.

FIG. 14 is an illustrative diagram showing the perspective view of a composite hair extension in accordance with this disclosure.

A person of ordinary skills in the art will appreciate that elements of the figures above are illustrated for simplicity and clarity, and are not necessarily drawn to scale. The dimensions of some elements in the figures may have been exaggerated relative to other elements to help understanding of the present teachings. Furthermore, a particular order in which certain elements, parts, components, modules, steps, actions, events and/or processes are described or illustrated may not be actually required. A person of ordinary skills in the art will appreciate that, for the purpose of simplicity and clarity of illustration, some commonly known and well-understood elements that are useful and/or necessary in a commercially feasible embodiment may not be depicted in order to provide a clear view of various embodiments in accordance with the present teachings.

DETAILED DESCRIPTION

Figure 1:
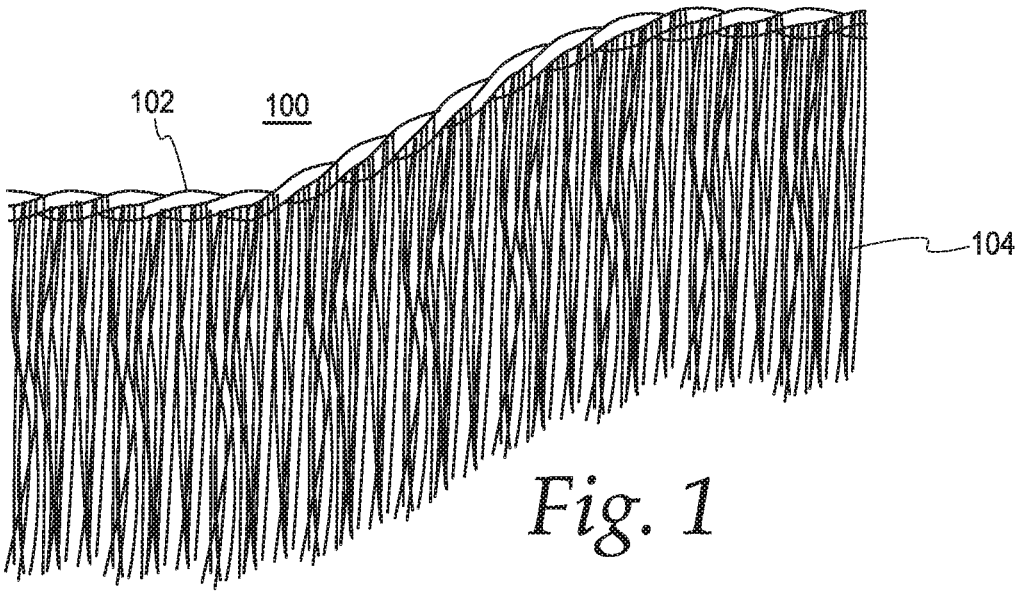
FIG. 1 is an illustrative diagram showing the perspective view of a new hair extension in accordance with this disclosure.

Turning to the Figures and to FIG. 1 in particular, a block diagram of a flexible hair extension with form retention capability is shown and generally indicated at 100. The new hair extension 100 includes a flexible attachment assembly 102 and a plurality of hairs 104 attached to the attachment assembly 102. In one embodiment, each hair within the plurality of hairs 104 is a natural human hair. In a different embodiment in accordance with the present teachings, each hair within the plurality of hairs 104 is a manufactured fiber, such as synthetic fiber. The hair extension 100 can be constructed with each hair within the plurality of hairs 104 of a predetermined color, size and other properties.

Figure 6:
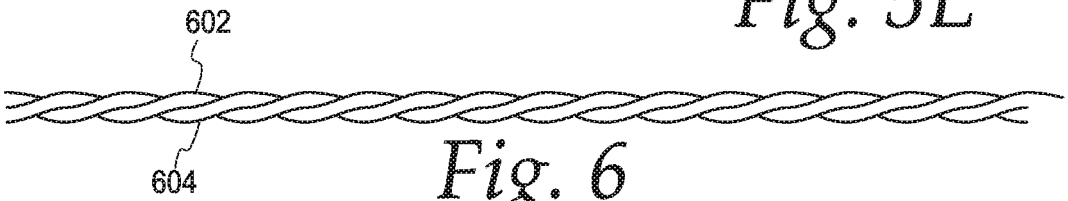
FIG. 6 is an illustrative diagram showing the perspective view of an attachment assembly of a new hair extension in accordance with this disclosure.

The plurality of hairs 104 are attached to the attachment assembly 102. In one embodiment, the attachment assembly 102 is a pair of wires 602 and 604 twisted together as shown in FIG. 6. The wires 602 and 604 can be two halves of a single wire folded and twisted to form the attachment assembly 102. In such a case, the wires 602 and 604 are regarded as two wires. Alternatively, the wires 602 and 604 are two separate pieces of wire. The malleable wires 602-604 can be made of metal, alloy or synthetic materials. Each hair within the plurality of hairs 104 is attached to the attachment assembly 102 by being disposed and held between the twisted wires 602-604 at one end. Alternatively, the plurality of hairs 104 are attached to the attachment assembly 102 as shown in FIG. 9A and FIG. 9B.

Referring now to FIG. 9A, a flexible hair extension with form retention capability is shown and generally indicated at 900. The new hair extension 900 includes an attachment assembly 902 and a plurality of hairs 906 (such as the plurality of hairs 104). The attachment assembly 902 includes a flexible wire 908 and a binding member 904. The plurality of hairs 906 are attached to the binding member 904, such as a strip of fabric, by, for example, glue. The binding member 904 is coupled to the flexible wire 908. In one embodiment, the member 908 is a single flexible wire or a pair of twisted wires 102, such as the wires 602-604; and the binding member 904 forms a channel receiving the wire 908. As used herein, the plurality of hairs 906 are said to be attached to the attachment assembly 902. Furthermore, as used herein, the plurality of hairs 906 are said to be operatively coupled to the attachment assembly 902, and the plurality of hairs 104 are said to be operatively coupled to the attachment assembly 102. The hair extension 900 is capable of providing all functions of the hair extension 100. When the plurality of hairs 906 are glued to the binding member 904, Keratin hair extension glue or other types of glue can be used.

The attachment assembly 102 is flexible and can be easily deformed, by hands of a user, into any desirable geometric shapes. In one implementation, the wires 602-604 are made of malleable metal. Moreover, the attachment assembly 102 is rigid enough to retain the shape, which it is deformed into, against gravity acting upon the hair extension 102. Furthermore, the shape is also maintained against normal wind blow against the hair extension.

In FIG. 9B, the hair extension indicated at 950 includes a plurality of hairs 956 glued to an attachment assembly 952. The attachment assembly 952 includes two wefts and a flexible wire glued between the two wefts. The wire can be easily deformed into any desired shapes by the hands of the user, and yet retain the shapes against gravity acting upon the plurality of hairs 956 and the attachment assembly 952.

Figure 2:
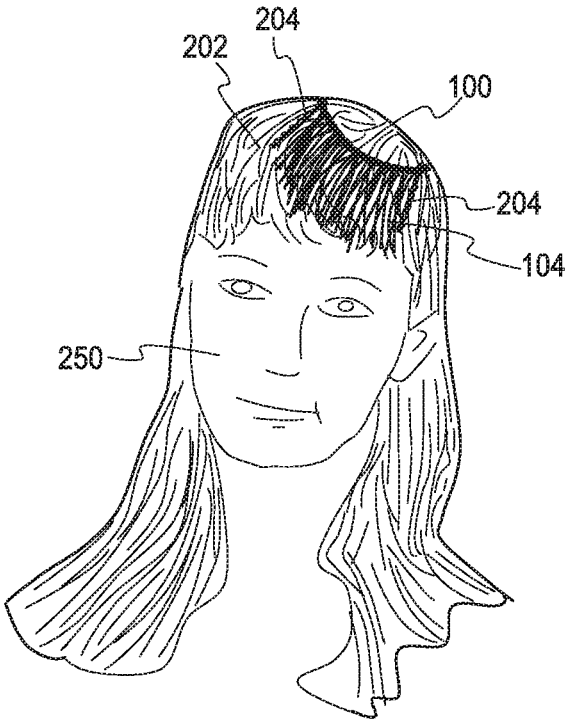
FIG. 2 is an illustrative diagram showing the perspective view of a human head wearing a new hair extension in accordance with this disclosure.
Figure 7:
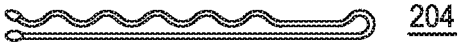
Fig. 7 (PRIOR ART)
FIG. 7 is an illustrative diagram showing a prior art hair clip.

Turning to FIG. 2, the hair extension 100 attached to a user's head 250 is shown. The hair extension 100 is attached to the user's natural hairs 202 via two hair clips 204 at a predetermined location and orientation. The prior art hair clips 204 are further illustrated in FIG. 7. Other suitable attachment instruments can also be used to attach the attachment assembly 102 to the natural hairs 202. The attachment assembly 102 is deformed by the user's hands to match the shape of the user's head 250 at the location where it is attached to. The attachment assembly 102 is deformed to create a desired appearance or style of the head 250. The attachment assembly 102 retains the shape that the user created against gravity of the hair extension 100.

After the two hair clips 204 are operated to attach two ends of the hair extension 100 to the user's natural hairs, the user operates the natural hairs 202 to cover the attachment assembly 102 to create a natural appearance. For example, the user grabs the hairs 202 and flips them over the attachment assembly 102.

Figure 3:
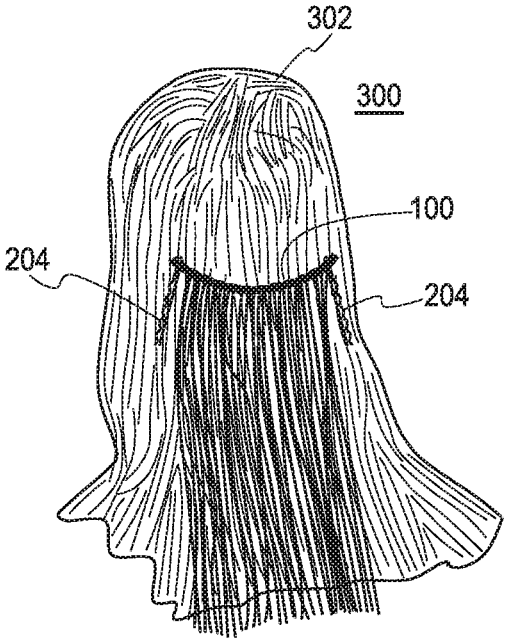
FIG. 3 is an illustrative diagram showing the perspective view of a human head wearing a new hair extension in accordance with this disclosure.
Figure 4:
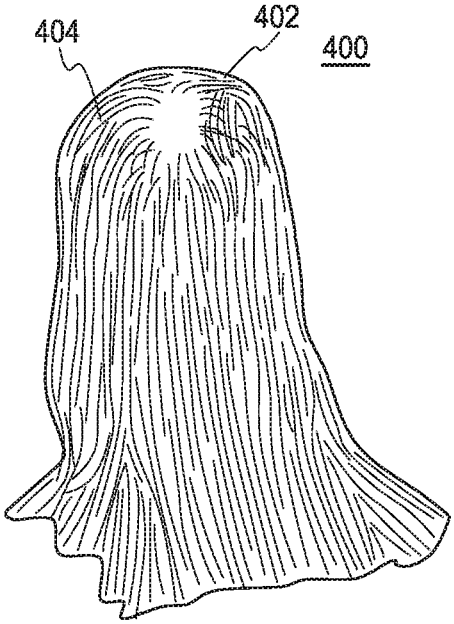
FIG. 4 is an illustrative diagram showing the perspective view of a human head with a hairless spot.

Turning to FIG. 3, the hair extension 100 attached to a user's head 300 is shown. The hair extension 100 is attached to the user's natural hairs 302 via two hair clips 204 at a predetermined location and orientation. After the two hair clips 204 are operated to attach two ends of the hair extension 100 to the user's natural hairs, the user operates the natural hairs 302 to cover the attachment assembly 102 to create a natural appearance. For example, the user grabs the hairs 302 and drops them over the attachment assembly 102. As shown in FIG. 3, the attachment assembly 102 is attached to the user head 300 in a substantial horizontal orientation. In contrast, in FIG. 2, the attachment assembly 102 is attached to the head 250 in a more vertical orientation.

The hair extension 100 is also adapted to cover hairless spots on a user's head to create a more natural appearance. Referring to FIGS. 4, 5A, 5B and 5C, a user's head with a hairless spot 402 is shown and generally indicated by 400. There are some natural hairs 404 around the hairless spot 402. Alternatively, the spot 402 has reduced amount of hairs than other areas on the head 400. In other words, the spot 402 has a thin layer of hairs 404. In such a case, the spot 402 is also referred to herein as a hairless spot.

To cover the spot 402 with the hair extension 100, the user deforms it into a substantially enclosing shape matching that of the hairless spot 402, and attaches it to the head 400 using, for example, the hair clips 204. The hair clips 204 bind the attachment assembly 102 to the natural hair 404. The head 400 with the hair extension 100 is shown in FIG. 5B.

Figure 5A:
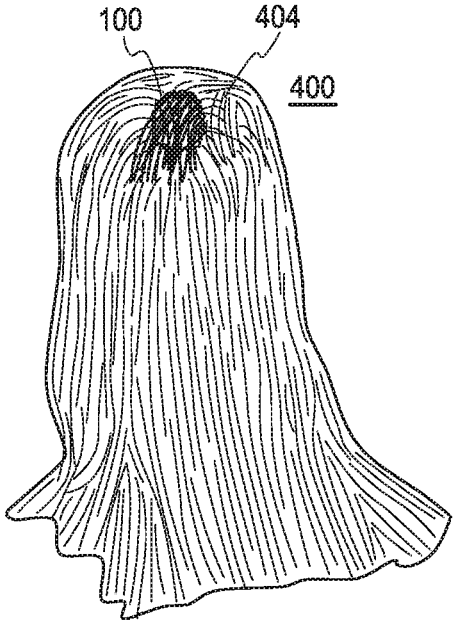
FIG. 5A is an illustrative diagram showing the perspective view of a human head with a new hair extension covering a hairless spot in accordance with this disclosure.
Figure 5B:
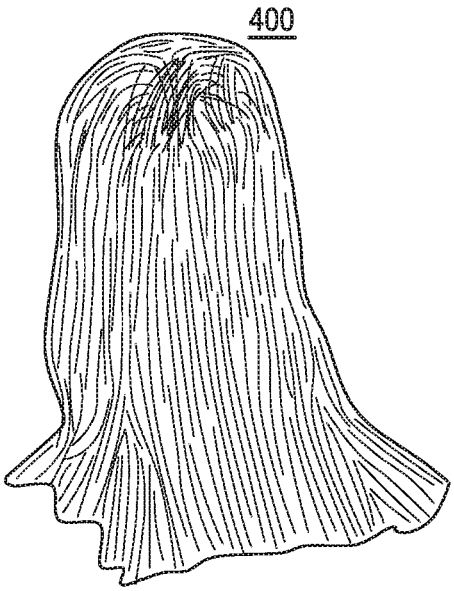
FIG. 5B is an illustrative diagram showing the perspective view of a human head with a new hair extension covering a hairless spot in accordance with this disclosure.
Figure 5C:
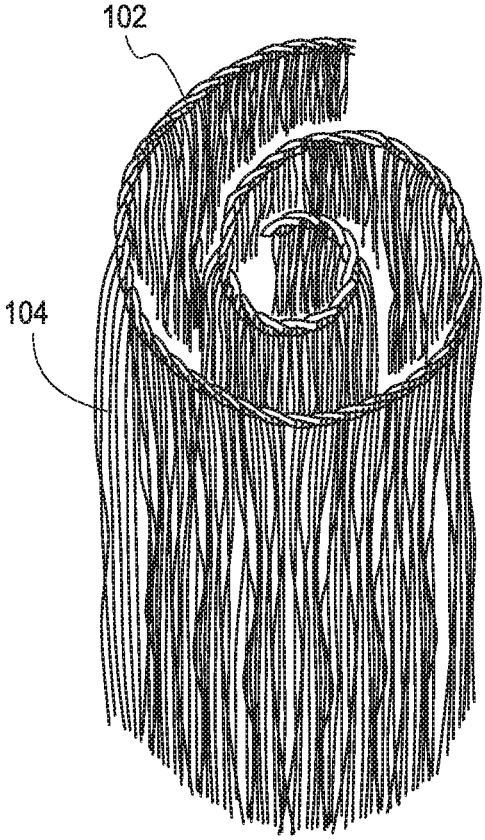
FIG. 5C is an illustrative diagram showing the perspective view of a new hair extension deformed into a different shape in accordance with this disclosure.

With the hair extension 100 in an enclosing shape, shown in FIG. 5A, may create an appearance that the hairs over the spot 402 is thinner than other area. To cure this shortcoming, the user may deform the hair extension 100 into a coil form shown in FIG. 5C. Once the coiled hair extension 100 is attached to the hairs 404, the hairs over the spot 402 no longer look thinner than other area. The attachment assembly 102 is rigid enough to retain the coiled form against gravity of the hair extension 100.

Figure 5D:
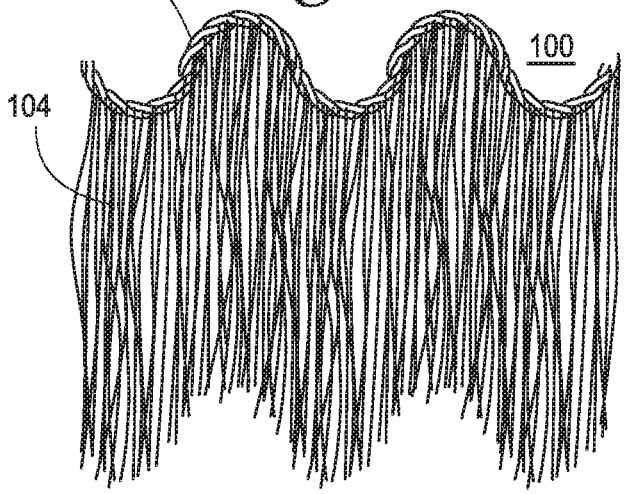
FIG. 5D is an illustrative diagram showing the perspective view of a new hair extension deformed into a different shape in accordance with this disclosure.
Figure 5E:
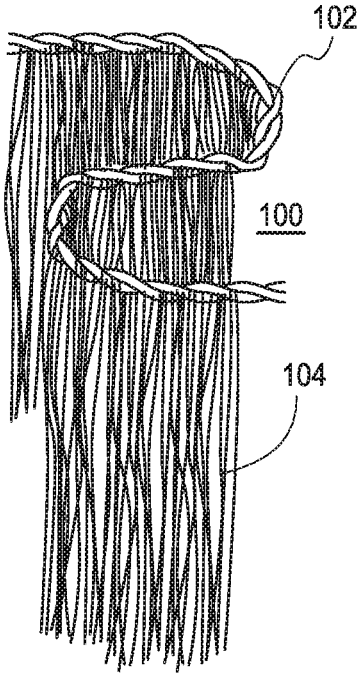
FIG. 5E is an illustrative diagram showing the perspective view of a new hair extension deformed into a different shape in accordance with this disclosure.
Figure 8A:
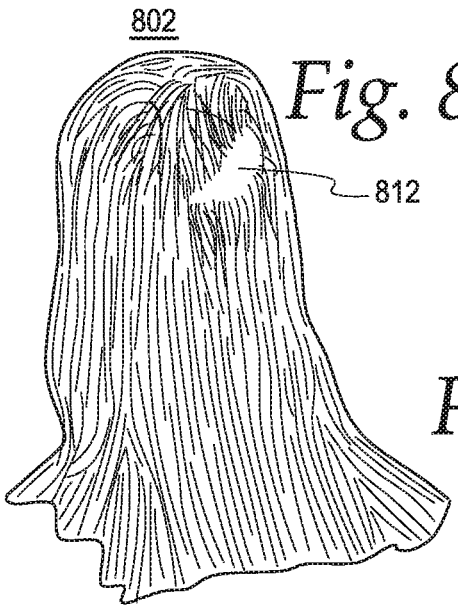
FIG. 8A is an illustrative diagram of a perspective view of a human head with a hairless spot.
Figure 8B:
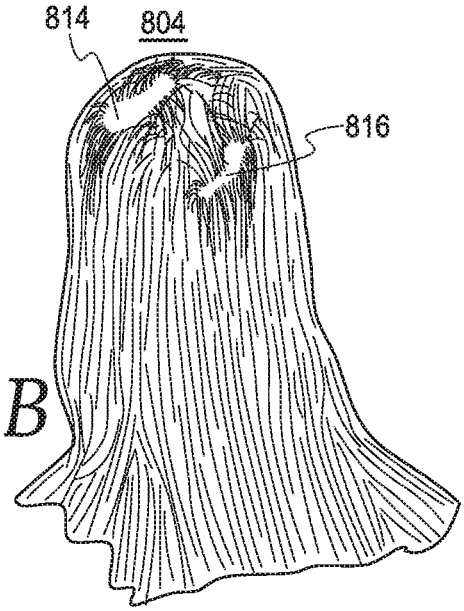
FIG. 8B is an illustrative diagram of a perspective view of a human head with multiple hairless spots.

The hair extension 100 can also be deformed into other desired shapes, such as those shown in FIGS. 5D and 5E. Moreover, the hair extensions 100 can be deformed into shapes that best fit the irregular hairless spot 812 on a head 802 shown in FIG. 8A, and the irregular hairless spots 814 and 816 on a head 804 shown in FIG. 8B without requiring the user to wear a hair piece to cover the entirety of the head 802 or 804.

Turning to FIG. 10, a new hair extension is shown and generally indicated at 1000. The hair extension 1000 includes an attachment assembly 1002 incorporating a set of hoops 1004. A user may weave her hairs through the hoops 1004 to create a desired style. The hair extension 1000 is flexible since it can be easily deformed by hands. Furthermore, the hair extension 1000 is rigid enough to maintain a shape, which it is formed into by hands, against the gravity of the hair extension 1000 and hairs running through the hoops 1004.

Turning to FIG. 11, a new hair extension is shown and generally indicated at 1100. The hair extension 1100 includes an attachment assembly 1102 incorporating a first weft 1104, a second weft 1106 operatively coupled to the first weft 1104, a flexible wire 1108 disposed between the wefts 1104-1106 when assembled, and a plurality of hairs 1110 attached to the second weft 1106. The wefts 1104-1106 are coupled together by, for example, sewing. In one embodiment, the wefts 1104-1106 are made of hairs or fibers, and the plurality of hairs 1110 are attached to the second weft 1106 via, for example, glue.

Referring to FIG. 12, an illustrative hair extension with form retention capability is generally shown and indicated at 1200. The hair extension 1200 includes the flexible wire 1108, and a plurality of hairs 1202 attached to the wire 1108. The hairs 1202 are tightly attached to the wire 1108. In one implementation, the plurality of hairs 1202 wrap around the wire 1108 and are then sewed together with the seam indicated at 1204. Each of the two ends of the hair extension 1200 is tied. In one implementation, each end is sewed together and coupled with an O-ring 1212.

Referring to FIG. 13, an illustrative new hair extension with form retention capability is generally shown and indicated at 1300. The composite hair extension 1300 includes a flexible attachment member 1304 and two hair extensions 1200. The two hair extensions 1200 attached to each other using the flexible attachment member 1304. In one implementation, the attachment member 1304 is a hemp cord and the two hair extensions 1200 are sewed together with the seam 1302 enclosing the hemp cord 1304.

The hair extension 1300 is flexible, and yet rigid enough to retain the shape, which it is deformed into, against the gravity of the hair extension 1300. Furthermore, the shape is also maintained against normal wind blow against the hair extension 1300.

Figure 15:
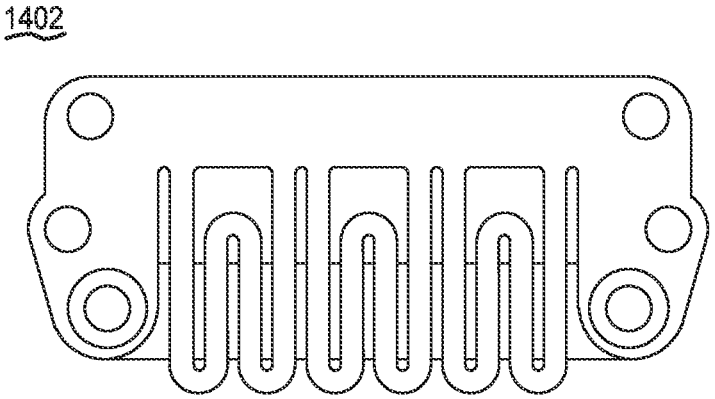
FIG. 15 is an illustrative diagram showing the perspective view of a prior art U-shaped snap clip.

Referring to FIG. 14, an illustrative new hair extension with form retention capability is generally shown and indicated at 1400. The composite hair extension 1400 includes the hair extension 1300 and a hair clip attached 1402 to the hair extensions 1300. In one implementation, the hair clip 1402 is a U-shaped snap clip for clipping on to a plurality of hairs. U-shaped snap clip 1402 is further illustrated in FIG. 15.

The In a different implementation, the hair extension includes more than one, such as two, three, four, five, etc., hair clips 1402 attached to the hair extension 1300. The hair extension 1400 is flexible, and yet rigid enough to retain the shape, which it is deformed into, against the gravity of the hair extension 1400. Furthermore, the shape is also maintained against normal wind blow against the hair extension 1400.

Figure 16:
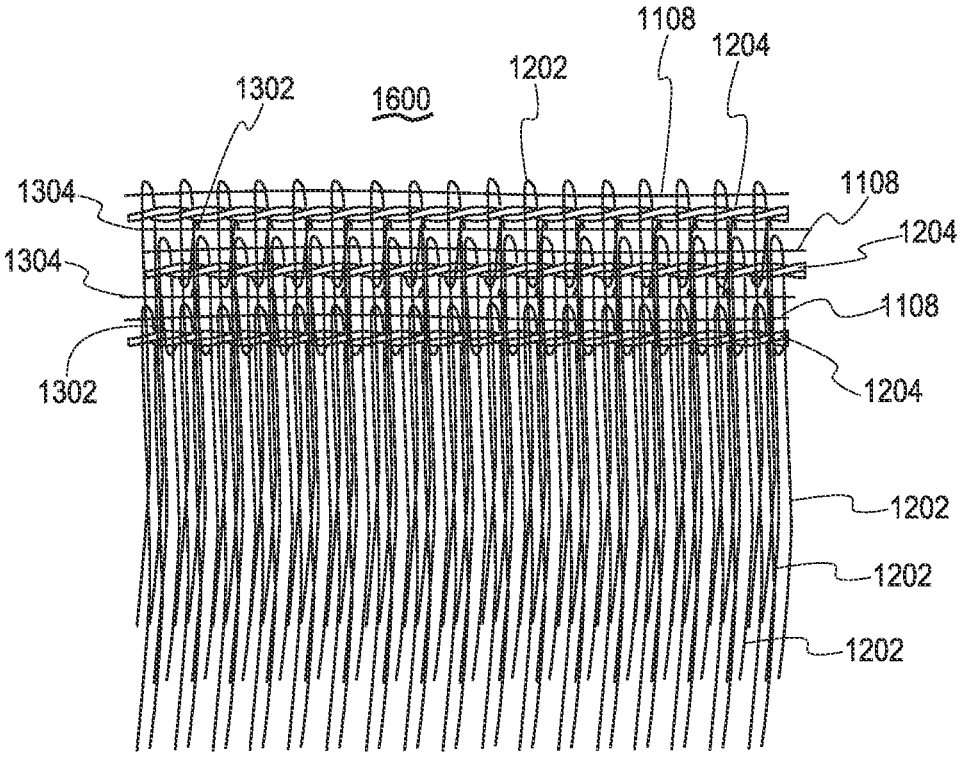
FIG. 16 is an illustrative diagram showing the perspective view of a composite hair extension in accordance with this disclosure.

Referring to FIG. 16, an illustrative new hair extension with form retention capability is generally shown and indicated at 1600. The composite hair extension 1600 includes two flexible attachment members 1304 and three hair extensions 1200. The three hair extensions 1200 attached together using two flexible attachment members 1304. In one implementation, the attachment members 1304 are two hemp cords and the three hair extensions 1200 are sewed together with the seams 1302 enclosing the hemp cords 1304 respectively. The hair extension 1600 is flexible, and yet rigid enough to retain the shape, which it is deformed into, against the gravity of the hair extension 1600. Furthermore, the shape is also maintained against normal wind blow against the hair extension 1600. In a further implementation, one or more hair clips, such as the hair clip 1402 are attached to the hair extension 1600.

Figure 17:
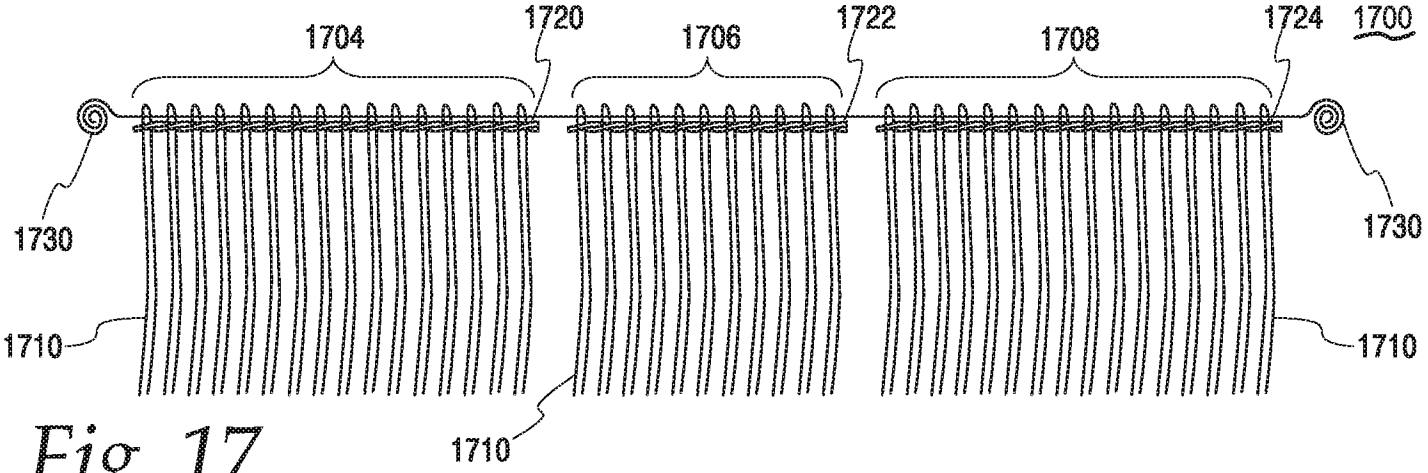
FIG. 17 is an illustrative diagram showing the perspective view of a sliding hair extension in accordance with this disclosure.

Referring to FIG. 17, an illustrative new hair extension with multiple sliding hair segments and form retention capability is generally shown and indicated at 1700. The sliding hair extension 1700 includes a plurality of sliding hair segments, such as the plurality of sliding hair segments 1704, 1706 and 1708. The plurality of sliding hair segments 1704-1706 are adapted to slide along the wire 1702 when pushed or pulled by a user using her fingers. The flexible wire 1702 is single wire or a plurality of wires. The flexible wire 1702 can be easily deformed by a user's hands, and yet retain the new shape against the gravity of the hair extension 1700. The flexible wire 1702 is termed herein an attachment assembly with form retention capability. In other words, the flexible wire 1702 is a form retention capable attachment assembly.

The plurality of sliding hair segments 1704-1706 each include a plurality of hairs 1710 attached to the wire 1702. In one implementation, the hairs 1710 are wrapped around the wire 1702 and sewn together. The seams are indicated at 1720, 1722 and 1724. The plurality of sliding hair segments 1704-1706 have the same length or different lengths along the wire 1702. The sliding hair extension 1700 also includes two attachment mechanisms 1730 at the two opposite ends of the wire 1702. The attachment mechanisms 1730 are used to attach the sliding hair extension 1700 to a target object, such as a hat. The attachment mechanism 1730 can be a twisted wire or a separate snap. The attachment mechanism 1730 is either integrally formed with the wire 1702 or attached to the wire 1702.

The sliding hair extension 1700 provides numerous benefits. For instance, a person without hair can attach it to the inside edge of a hat. For example, a cancer patient going through a treatment may lose all her/his hairs. In such a case, the patient can use the sliding hair extension 1700 for a different look. The sliding hair segments 1704-1708 allow the user to position hairs around her/his head. For instance, the user may push the sliding hair segments 1704-1708 away from her/his forehead.

Figure 18:
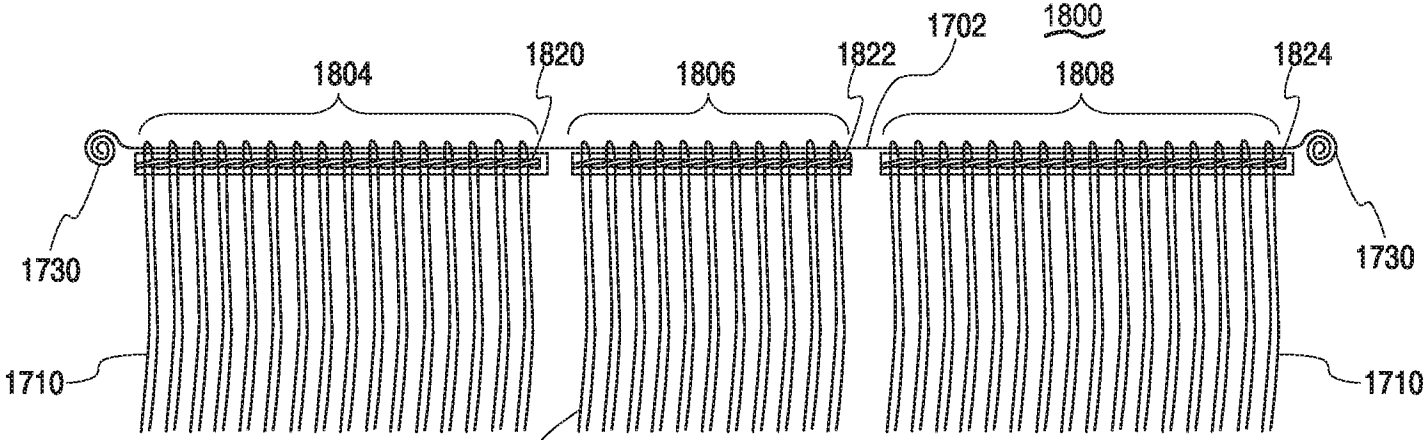
FIG. 18 is an illustrative diagram showing the perspective view of a sliding hair extension in accordance with this disclosure.

Referring to FIG. 18, an illustrative new hair extension with multiple sliding hair segments of a different implementation is generally shown and indicated at 1800. The sliding hair extension 1800 includes a plurality of sliding hair segments 1804, 1806 and 1808 attached to the wire 1702. In this implementation, the hairs 1710 are attached to separate wefts 1820, 1822 and 1824 respectively. The wefts 1820-1824 adapted to slide along the wire 1702.

Obviously, many additional modifications and variations of the present disclosure are possible in light of the above teachings. Thus, it is to be understood that, within the scope of the appended claims, the disclosure may be practiced otherwise than is specifically described above. For example, the hair extensions 100 and 900 are adapted to create different hair styles. As an additional example, the attachment assemblies 102 and 902 can maintain their physical properties and functions after application of heat from a hair blow dryer, a hair curling iron, and a flat iron. As another example, the hair extensions 100 and 900 are adapted to be used with pony tails.

The foregoing description of the disclosure has been presented for purposes of illustration and description, and is not intended to be exhaustive or to limit the disclosure to the precise form disclosed. The description was selected to best explain the principles of the present teachings and practical application of these principles to enable others skilled in the art to best utilize the disclosure in various embodiments and various modifications as are suited to the particular use contemplated. It should be recognized that the words "a" or "an" are intended to include both the singular and the plural. Conversely, any reference to plural elements shall, where appropriate, include the singular.

It is intended that the scope of the disclosure not be limited by the specification, but be defined by the claims set forth below. In addition, although narrow claims may be presented below, it should be recognized that the scope of this invention is much broader than presented by the claim (s). It is intended that broader claims will be submitted in one or more applications that claim the benefit of priority from this application. Insofar as the description above and the accompanying drawings disclose additional subject matter that is not within the scope of the claim or claims below, the additional inventions are not dedicated to the public and the right to file one or more applications to claim such additional inventions is reserved.

What is claimed is:

1. A composite hair extension with form retention capability comprising:

i.) a first flexible hair extension with form retention capability having a first attachment assembly including a first malleable wire with form retention capability and a first plurality of hairs attached to said first attachment assembly at points along a length of the first malleable wire, the first plurality of hairs being wrapped around the first malleable wire and sewed together;

ii.) a second flexible hair extension with form retention capability having a second attachment assembly including a second malleable wire with form retention capability and a second plurality of hairs attached to said second attachment assembly at points along a length of the second malleable wire, the second plurality of hairs being wrapped around the second malleable wire and sewed together;

iii.) an elongate first flexible attachment member, said second flexible hair extension being sewed together with said first flexible hair extension to form a seam, the seam enclosing said first flexible attachment member, so that the respective lengths of the first malleable wire, the second malleable wire, and the first flexible attachment member are aligned;

wherein the first and second attachment assemblies are deformable by hand into a deformed shape;

wherein the composite hair extension has a length of the composite hair extension extending from one of the opposite ends to the other opposite end of the composite hair extension, the composite hair extension being operative to be worn on a human user's head by attaching the first and second attachment assemblies in the deformed shape to the user's natural hairs in such a manner that a free segment of said length is free of attachment to the user's natural hairs, the free segment comprising a free portion of the deformed shape;

wherein the first and second attachment assemblies are operative to resist further deformation of the free portion of the deformed shape when gravity acts upon the composite hair extension so worn on the user's head, so that the composite hair extension is form retention capable.

2. The composite hair extension of claim 1 wherein said first attachment assembly includes:

i.) an additional malleable wire with form retention capability twisted together with said first malleable wire wherein said first plurality of hairs are disposed between said first and additional malleable wires;

ii.) a binding member coupled to said first malleable wire, wherein said first plurality of hairs are attached to said binding member; or iii.) two wefts, the first malleable wire being disposed between said two wefts.

3. The composite hair extension of claim 2 wherein said first flexible attachment member is a hemp cord.

4. The composite hair extension of claim 1 further comprising:

i.) a third flexible hair extension with form retention capability having a third attachment assembly including a third malleable wire with form retention capability and a third plurality of hairs attached to said third attachment assembly at points along a length of the third malleable wire, the third plurality of hairs being wrapped around the third malleable wire and sewed together; and ii.) an elongate second flexible attachment member, said third flexible hair extension being sewed to said second flexible hair extension to form a seam, the seam enclosing said second flexible attachment member, so that the respective lengths of the second malleable wire, the third malleable wire, and the second flexible attachment member are aligned.

5. The composite hair extension of claim 4 wherein said second flexible attachment member is a hemp cord.

6. A hair extension with form retention capability comprising:

i.) an attachment assembly with a set of malleable wires comprising at least one malleable wire with form retention capability; and ii.) a plurality of hairs attached to said attachment assembly at points along the length of the malleable wire, the plurality of hairs being wrapped around the malleable wire and sewed together;

wherein the malleable wire is deformable by hand into a deformed shape;

wherein the hair extension is operative to be worn on a human user's head by attaching the malleable wire in the deformed shape to the user's natural hairs in such a manner that a free segment of said length is free of attachment to the user's natural hairs, the free segment comprising a free portion of the deformed shape;

wherein the malleable wire is operative to resist further deformation of the free portion of the deformed shape when gravity acts upon the hair extension when the hair extension is so worn on the user's head, so that the hair extension is form retention capable.

7. The hair extension of claim 6 wherein said attachment assembly includes a first weft and a second weft coupled to said first weft and said at least one malleable wire is a single malleable wire disposed between said two wefts, wherein said plurality of hairs are attached to said second weft.

8. The hair extension of claim 6 wherein said attachment assembly includes two weft and said at least one malleable wire is a single malleable wire disposed between said two wefts, wherein one end of said plurality of hairs is disposed between said two wefts.

9. The hair extension of claim 6 wherein said attachment assembly includes a binding member and said at least one malleable wire is a single malleable wire coupled to binding member, wherein said plurality of hairs are attached to said binding member.

10. The hair extension of claim 6 wherein said at least one malleable wire includes two malleable wires twisted together, said plurality of hairs being disposed between said two malleable wires.

11. The hair extension of claim 6 wherein said at least one malleable wire is a single malleable wire.

12. A hair extension with form retention capability comprising:

i.) an attachment assembly with a malleable wire, said malleable wire being form retention capable;

ii.) at least one hair segment attached to said attachment assembly, each said at least one hair segment including a plurality of hairs at points along a length of said malleable wire, the plurality of hairs being wrapped around the malleable wire and sewed together to form a hair segment loop; and iii.) two attachment mechanisms at two opposite ends of said malleable wire, said two attachment mechanisms being adapted to attach said hair extension to a target object;

wherein the malleable wire is deformable by hand into a deformed shape;

wherein the hair extension is operative to be worn on a human user's head by attaching only the attachment mechanisms of said malleable wire in the deformed shape to the user's natural hairs, so that a free segment of said length of the malleable wire is free of attachment to the user's natural hairs, the free segment comprising a free portion of the deformed shape;

wherein the malleable wire is operative to resist further deformation of the free portion of the deformed shape when gravity acts upon the hair extension when the hair extension is so worn on the user's head, so that the hair extension is form retention capable.

13. The hair extension of claim 12 wherein each said at least one hair segment comprises a plurality of hair segments of different lengths.

14. The hair extension of claim 12 wherein the hair segment loop retains the hair segment on the malleable wire so that each said hair segment is a sliding hair segment adapted to slide along the malleable wire when pushed or pulled by a user's fingers.

* * * * *